US009144895B2

(12) United States Patent
Kearney

(10) Patent No.: US 9,144,895 B2
(45) Date of Patent: Sep. 29, 2015

(54) MOTORIZED CASKET/COFFIN KEY/CRANK

(71) Applicant: Kevin Patrick Kearney, Taylor, PA (US)

(72) Inventor: Kevin Patrick Kearney, Taylor, PA (US)

( * ) Notice: Subject to any disclaimer, the term of this patent is extended or adjusted under 35 U.S.C. 154(b) by 411 days.

(21) Appl. No.: 13/738,982

(22) Filed: Jan. 10, 2013

(65) Prior Publication Data

US 2014/0190313 A1 Jul. 10, 2014

(51) Int. Cl.
*B25B 21/00* (2006.01)
*B25F 5/00* (2006.01)

(52) U.S. Cl.
CPC ..... *B25B 21/002* (2013.01); *B25F 5/00* (2013.01)

(58) Field of Classification Search
CPC B25B 21/002; B25B 21/007; B25B 23/0021; B25F 5/00; B23B 45/02; A61G 17/02; E05B 65/0057
USPC ..... 81/52, 57.13
See application file for complete search history.

(56) References Cited

U.S. PATENT DOCUMENTS

| | | | | |
|---|---|---|---|---|
| 4,413,390 | A * | 11/1983 | Blaese et al. | 27/32 |
| 5,015,129 | A * | 5/1991 | Albin | 408/239 A |
| 5,421,180 | A * | 6/1995 | Rojdev | 70/456 R |
| 6,321,855 | B1 * | 11/2001 | Barnes | 173/211 |
| 7,134,364 | B2 * | 11/2006 | Kageler et al. | 81/52 |
| 7,185,562 | B2 * | 3/2007 | Raines et al. | 81/52 |
| 7,814,816 | B2 * | 10/2010 | Alberti et al. | 81/57.13 |
| 8,117,950 | B2 * | 2/2012 | Kozak et al. | 81/177.6 |
| 2003/0089511 | A1 * | 5/2003 | Tsuneda et al. | 173/217 |
| 2009/0277313 | A1 * | 11/2009 | Wise | 81/474 |
| 2011/0064978 | A1 * | 3/2011 | McGahan et al. | 429/61 |
| 2011/0154973 | A1 * | 6/2011 | Christmas | 84/413 |

* cited by examiner

*Primary Examiner* — David B Thomas

(57) ABSTRACT

A motorized casket/coffin crank raises and lowers a casket/coffin bed effortlessly and with minimal sound emission. The casket/coffin crank can be used similar to a drill to be inserted into the bed device's hole and, with its long shaft, turning the key, which is typically hidden underneath the fabric lining in both the head and foot ends of the casket/coffin, allow the raising and lowering of the casket bed at an accelerated rate without requiring the effort typically required with manual cranks.

11 Claims, 3 Drawing Sheets

MOTORIZED CASKET/COFFIN KEY/CRANK

BACKGROUND OF THE INVENTION

The present invention relates to casket/coffin accessories and, more particularly, to a motorized casket/coffin key/crank that can reduce the time and effort in raising and lowering a casket/coffin bed.

The raising and lowering of a typical casket/coffin bed takes manual effort, including from about 45 to about 48 rotations of the standard casket key/crank, and time, typically from about 40 to 45 seconds from bed base to its peak level.

Current conventional cranks/keys work as expected—requiring effort and time. In a business where funeral directors are typically pressed for time, saving those precious seconds is crucial As can be seen, there is a need for a device for quickly and easily raising and lowering a casket/coffin bed.

SUMMARY OF THE INVENTION

In one aspect of the present invention, a motorized casket/coffin key/crank comprises a motor; a shaft, rotatable by the motor, fitting into an outer casket shaft port and extending to an inner casket female receiver crank port; a bit at an end of the shaft, the bit fitting into the inner casket female receiver crank port; a battery powering the motor; and an activation switch electrically connecting the battery with the motor.

In another aspect of the present invention, a motorized casket/coffin key/crank comprises a motor; a shaft extending orthogonal from the motor and rotatable by the motor, the shaft fitting into an outer casket shaft port and extending to an inner casket female receiver crank port; a bit at an end of the shaft, the bit fitting into the inner casket female receiver crank port; a battery powering the motor; an activation switch electrically connecting the battery with the motor; and a decibel lowering device operable to minimize sound emission from the motor during use.

In a further aspect of the present invention, a method for raising and lowering a casket/coffin bed comprises inserting a shaft through an outer casket shaft port; fitting a bit at a first end of the shaft into an inner casket female receiver crank port inside a casket/coffin; and turning the bit with a motor disposed at a second, opposite end of the shaft.

These and other features, aspects and advantages of the present invention will become better understood with reference to the following drawings, description and claims.

DETAILED DESCRIPTION OF THE INVENTION

Figure 1:
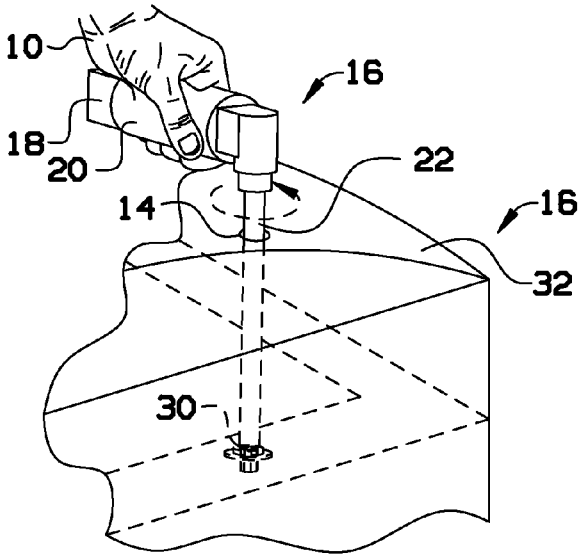
FIG. 1 is a detailed perspective view of a casket/coffin key/crank, in use, according to an exemplary embodiment of the present invention.
Figure 2:
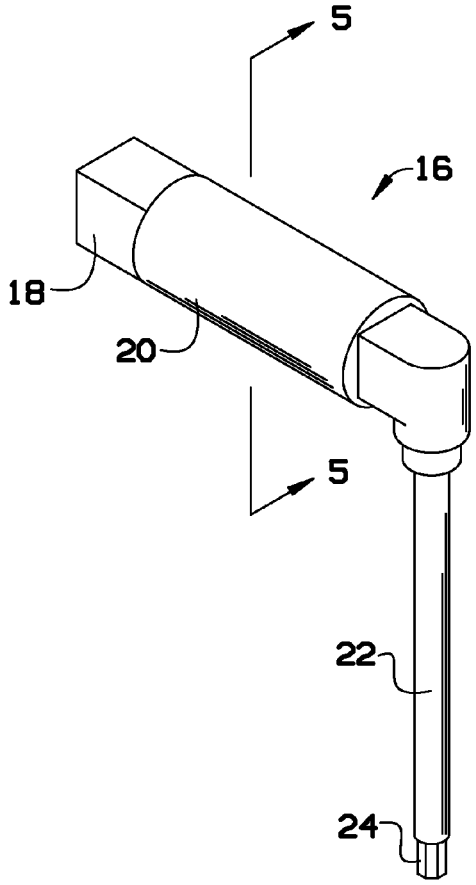
FIG. 2 is a perspective view of the casket/coffin key/crank of FIG. 1.
Figure 3:
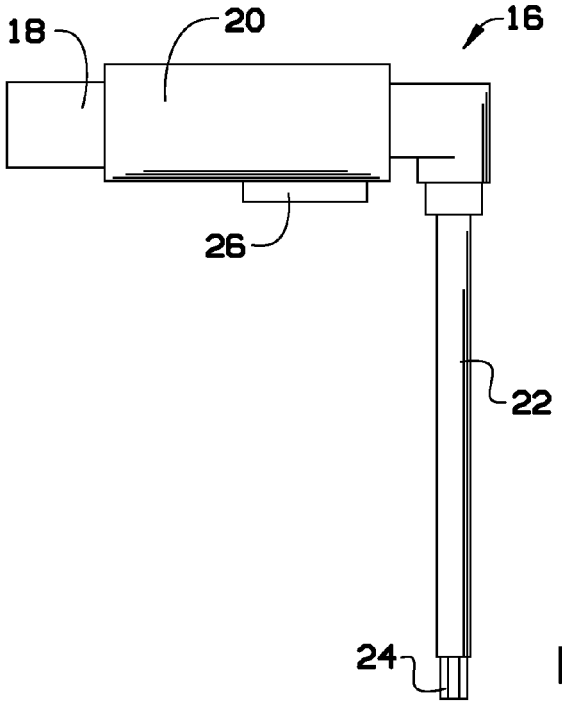
FIG. 3 is a side view of the casket/coffin key/crank of FIG. 1.
Figure 4:
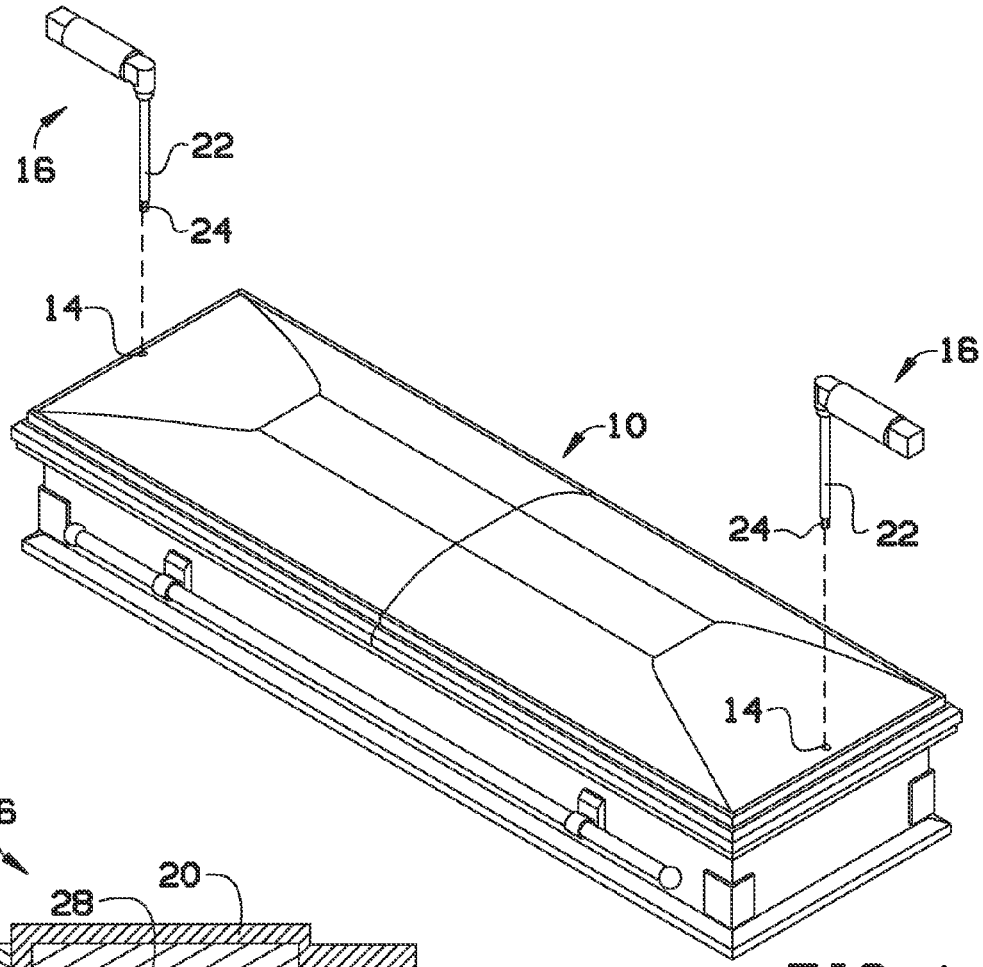
FIG. 4 is a perspective view showing positioning of the casket/coffin keys/cranks of FIG. 1, removed from outer casket shaft ports of the casket/coffin.
Figure 5:
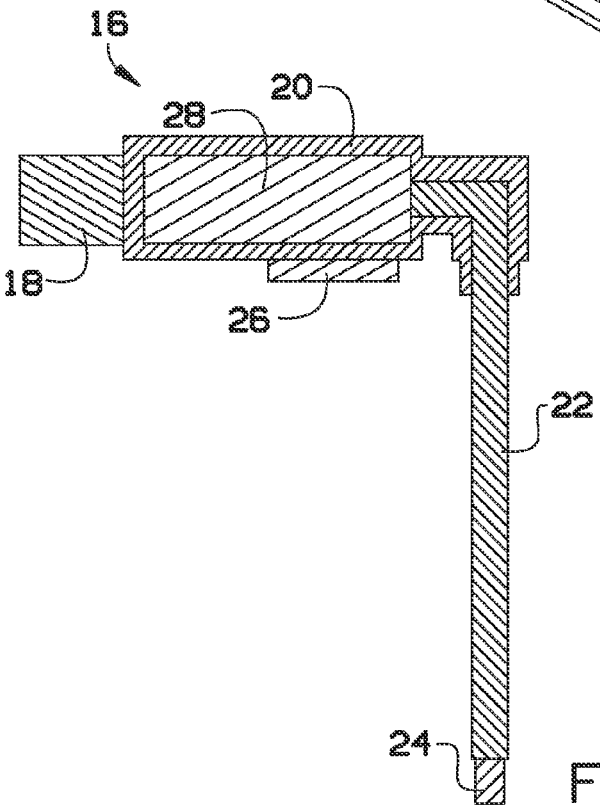
FIG. 5 is a cross-sectional view taken along line 5-5 of FIG. 2.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a motorized casket/coffin crank for raising and lowering a casket/coffin bed effortlessly and with minimal sound emission. The casket/coffin crank can be used similar to a drill to be inserted into the bed device's hole and, with its long shaft, turning the key, which is typically hidden underneath the fabric lining in both the head and foot ends of the casket/coffin, allow the raising and lowering of the casket bed at an accelerated rate without requiring the effort typically required with manual cranks.

Referring now to FIGS. 1 through 6, a motorized casket/coffin key/crank can include a motor 28, disposed in a motor case 20 and powered by, for example, a battery 18. The motor case 20 can be formed with a soft, comfortable grip, if desired.

The battery 18 could be removable and rechargeable or the entire motorized casket/coffin key/crank can be placed in a charger (not shown) for recharging the battery 18. Typically, the motor 28 is a low decibel motor so as not to provide significant sound emissions during use by an operator 10, such as a funeral director. A decibel lowering device 16, such as motor insulation or the like, can be used to minimize sound emission from the motor 28.

Figure 6:
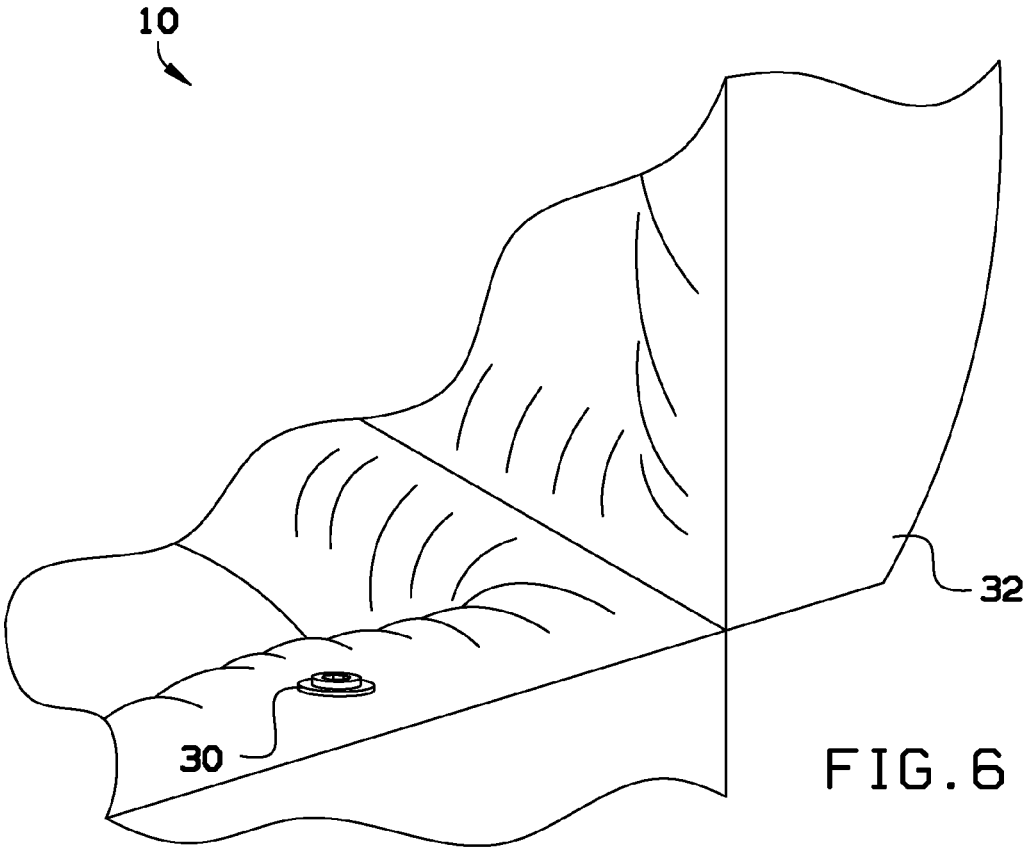
FIG. 6 is a detailed perspective view of an exemplary casket/coffin illustrating a casket door in an open position to show the inner casket octagonal female receiver crank port.

The motor 28 can turn a shaft 22. The shaft 22 can have sufficient length to fit through an outer casket shaft port 14 and reach an inner casket octagonal female receiver crank port 30 inside the casket/coffin 12. FIG. 6 shows an exemplary position of the inner casket octagonal female receiver crank port 30 when a casket door 32 is opened on the casket/coffin 12. Typically, the motor can be horizontally mounted, while the shaft extends orthogonally (vertically) from the motor. However, the casket/coffin key/crank of the present invention could be formed in a linear arrangement.

The end of the shaft 22 can include an octagonal bit 24 for fitting into an inner casket octagonal female receiver crank port 30 (see FIGS. 1 and 6). In some embodiments, the octagonal bit 24 can be a removable bit so that, should the bit become rounded, a new bit can be inserted. In other embodiments, the octagonal bit 24 can be formed integrally with the shaft 22. While an octagonal bit is shown and described, should a casket/coffin use a different shape female receiver crank port, then the octagonal bit can be replaced with a male bit fitting into the female receiver crank port.

An activation button 26 can be used to turn the motor 28 on and off. In some embodiments, the activation button 26 can provide variable power to the motor 28, resulting in a variable speed feature. In some embodiments, the activation button 26 could be a two (or more) position button, providing two (or more) speeds for the casket/coffin key/crank. For example, squeezing the activation button 26 a first distance can result in a first speed, where continued further squeezing of the activation button 26 can cause a second, third or more speed to occur. Typically, the motor 28 can provide a speed from about 100 to about 400 revolutions per minute (rpm), typically about 300 rpm. The motor 28 can generate torque on the order from about 10 to about 30, typically about 20 foot-pounds.

It should be understood, of course, that the foregoing relates to exemplary embodiments of the invention and that modifications may be made without departing from the spirit and scope of the invention as set forth in the following claims.

What is claimed is:

1. A motorized casket/coffin key/crank comprising:

a motor;

a shaft, rotatable by the motor, fitting into an outer casket shaft port and extending to an inner casket female receiver crank port;

a bit at an end of the shaft, the bit fitting into the inner casket female receiver crank port;

a battery powering the motor; and an activation switch electrically connecting the battery with the motor.

2. The motorized casket/coffin key/crank of claim 1, wherein the motor is disposed orthogonally to the shaft.

3. The motorized casket/coffin key/crank of claim 1, further comprising a decibel lowering device operable to minimize sound emission from the motor during use.

4. The motorized casket/coffin key/crank of claim 1, wherein the motor turns the shaft at about 300 revolutions per minute.

5. The motorized casket/coffin key/crank of claim 1, wherein the motor provides about 20 foot-pounds of torque.

6. A motorized casket/coffin key/crank comprising:

a motor;

a shaft extending orthogonal from the motor and rotatable by the motor, the shaft fitting into an outer casket shaft port and extending to an inner casket female receiver crank port;

a bit at an end of the shaft, the bit fitting into the inner casket female receiver crank port;

a battery powering the motor;

an activation switch electrically connecting the battery with the motor; and a decibel lowering device operable to minimize sound emission from the motor during use.

7. The motorized casket/coffin key/crank of claim 6, wherein the motor turns the shaft at about 300 revolutions per minute.

8. The motorized casket/coffin key/crank of claim 6, wherein the motor provides about 20 foot-pounds of torque.

9. A method for raising and lowering a casket/coffin bed, the method comprising:

inserting a shaft through an outer casket shaft port;

fitting a bit at a first end of the shaft into an inner casket female receiver crank port inside a casket/coffin; and turning the bit with a motor disposed at a second, opposite end of the shaft.

10. The method of claim 9, wherein the motor is disposed orthogonally to the shaft.

11. The method of claim 9, further comprising minimizing sound emission from the motor with a decibel lowering device.

* * * * *